US007312717B2

(12) United States Patent
Schmidt-Troschke et al.

(10) Patent No.: US 7,312,717 B2
(45) Date of Patent: Dec. 25, 2007

(54) GAG BAG

(75) Inventors: Sebastian Schmidt-Troschke, Essen (DE); Gregor Leinweber, Herten (DE)

(73) Assignee: Gag Bag GmbH, Herten (DE)

( * ) Notice: Subject to any disclaimer, the term of this patent is extended or adjusted under 35 U.S.C. 154(b) by 158 days.

(21) Appl. No.: 11/124,800

(22) Filed: May 9, 2005

(65) Prior Publication Data

US 2005/0285749 A1 Dec. 29, 2005

(30) Foreign Application Priority Data

Jun. 23, 2004 (DE) ..... 20 2004 009 905 U

(51) Int. Cl.
*G08B 21/00* (2006.01)

(52) U.S. Cl. ..... 340/686.1; 340/568.7

(58) Field of Classification Search ..... 340/686.1, 340/328, 384.1, 691.1, 692, 568.7; 383/42
See application file for complete search history.

(56) References Cited

U.S. PATENT DOCUMENTS

| | | | | |
|---|---|---|---|---|
| 4,584,571 | A * | 4/1986 | Smit et al. | 340/568.7 |
| 6,133,831 | A * | 10/2000 | Kyles | 340/568.7 |
| 6,137,410 | A * | 10/2000 | Sepulveda | 340/568.7 |
| 6,283,299 | B1 * | 9/2001 | Lee | 206/760 |
| 6,478,152 | B1 | 11/2002 | Mansfield | |
| 6,595,687 | B2 * | 7/2003 | Godshaw et al. | 383/6 |
| 6,737,959 | B2 | 5/2004 | Ho | |
| 6,864,791 | B1 * | 3/2005 | Kam | 340/568.7 |

FOREIGN PATENT DOCUMENTS

GB 2376223 A 6/2001

* cited by examiner

*Primary Examiner*—John Tweel, Jr.
(74) *Attorney, Agent, or Firm*—Milde & Hoffberg, LLP

(57) ABSTRACT

The present invention relates to a packaging bag, in particular of paper, plastic or a composite of these materials, having a closable top and a sound source producing a single or a sequence of tones, sounds and/or noises when the top is opened. To provide a packaging bag with a reliably functioning sound source which is activated when the packaging bag is opened, the top is closable using a closure means.

6 Claims, 1 Drawing Sheet

GAG BAG

BACKGROUND OF THE INVENTION

The present invention relates to a packaging bag, in particular of paper, plastic or a composite of these materials, with a closable top, and a sound source which generates a single or a sequence of tones, sounds and/or noises when the bag is opened at the top. Such packaging bags are made in various types of folds, as folding bags with a bottom and/or side fold, as a block bottom bag, or without a fold. For heavy goods or for decorative purposes, the packaging bags can be provided with grips, handles or the like at the top.

Packaging bags of the type mentioned above are known from GB 2376223A. As is well known, they are labeled with logos, lettering or other designs and used as carriers of promotional messages, gift packaging or the like. In particular in personalized marketing, the packaging bags provided with advertising are used, for example, to present certain promotional gifts, information material etc. to the persons of interest. As a gift packaging, they are an alternative to other usual packaging materials.

The reproduction of certain texts, tunes, noises or the like when the packaging bag is opened, enhances the amount of attention which the recipient focuses on the packaging bags, which substantially improves, for example, the success of a marketing campaign or enhance the joy experienced by the recipient of the gift. In any case, the packaging bags serve as a receptacle for an item accommodated and presented in it.

The prior art packaging bags have a drawback, however, in that they cannot be reliably closed. There is therefore a risk that the packaging bag is inadvertently opened and the sound source is activated before the desired moment. Moreover, if the opening remains undetected, there is a continuous discharge of the source of energy until it is completely depleted and the sound source is therefore useless.

SUMMARY OF THE INVENTION

It is therefore an object of the present invention to provide a packaging bag which has a reliably functioning sound source which is activated when the packaging bag is opened.

The present invention solves this problem by providing a packaging bag with the features of claim 1. Advantageous embodiments of the present invention are defined in the dependent claims.

The characterizing feature of the packaging bag according to the present invention is the closability of the top of the packaging bag using a closure means. The use of the closure means thereby ensures that the packaging bag is not inadvertently opened and the sound source is sounded before this is indeed desired. The closure means also prevents the top from being inadvertently opened and the energy source depleted, without being realized, to a point where the sound source becomes useless.

The type of tones, sounds or noises generated when the packaging bag is opened can be freely adapted to the exterior design of the packaging bag. In the case of its use as a promotional item, the sound source can be designed in such a way, for example, that it produces a jingle or slogan which is typical for the firm presenting the gift when the bag is opened.

A packaging bag designed as a gift packaging of the type of the present invention can be configured in such a way, for example, that when the packaging bag is opened, congratulations are performed in musical or spoken form.

When the outer appearance is combined with a corresponding sound source, the packaging bag can also be used without contents. As an example, the use of a packaging bag with the label saying "a bag full of luck", which can be combined with a sound source, which when the bag is opened produces the noises of a happy and loudly grunting pig as a symbol of good luck and with the effect of producing happy emotions in the user.

The embodiment of the present invention of the packaging bags makes it possible to provide a reliably functioning packaging bag which achieves higher levels of attention with the user. In the case of the use of the packaging bag of the present invention as a promotional item, this would mean that a high degree of promotional effectiveness is achieved for the product or the firm being promoted. A loss of image, which would result if the packaging bag was malfunctioning, is therefore effectively avoided.

As a sound source, generally any sound source could be used, which can be cheaply manufactured and may be easily integrated in the packaging bag. However, according to an advantageous embodiment of the present invention, the sound source, however, comprises a sound chip and a loudspeaker associated with it.

The sound chip, which can be combined with an energy source, is a particularly cheap means of producing the noises, tones or sounds via the loudspeaker coupled to the sound chip, when the top of the packaging bag is opened. In particular with mass production, the sound source developed in this way has the advantage of low manufacturing costs, so that the packaging bag according to the present invention can be produced at particularly low cost.

According to another embodiment of the present invention, the sound chip can also be equipped with a recording unit, such as a microphone, which makes it possible to record a personalized message which is then reproduced when the packaging bag is opened.

According to yet another embodiment of the present invention, the loudspeaker is configured in such a way that the sounds, tones and noises generated by the sound chip are radiated to the outside, i.e. the loudspeaker is directed such that the sound waves are directed away from the packaging bag. With such an arrangement of the loudspeaker the cavity formed by the packaging bag can be used as a resonating body so that the tones, noises or sounds emanating from the sound source can be particularly well recognized by the user. To hide from the user the fact that this is not the usual kind of packaging bag, the front of the loudspeaker and the entire technical apparatus can be hidden behind an exterior wall or a double wall of the packaging bag.

The loudspeaker and/or the sound chip can be arranged at any desired place on the packaging bag. However, according to an advantageous embodiment of the present invention, the loudspeaker and/or the sound chip are arranged at the bottom of the packaging bag. Such an arrangement, in particular the arrangement under an insert bottom inserted on the bottom of the packaging bag which additionally stiffens the bottom area of the packaging bag prevents in a particularly reliable manner the sound source from being damaged when the packaging bag is filled or, after filling, by the goods arranged within the packaging bag, which could make the sound source useless.

The design of the closure means is generally freely selectable. According to another advantageous embodiment of the present invention, it can be formed, for example by the use of individual magnetic elements, of a Velcro fastener, by an adhesive glue or a ribbon and/or a press stud, so that the top can be repeatedly opened and closed. The packaging bag can thus be used repeatedly.

According to another embodiment of the present invention, two carrying handles are arranged at the top of the packaging bag. The use of the carrying handles, which can be decorative cords or the like, improve the outer appearance of the packaging bag. It also improves carrying ease, in particular in those cases where heavy items have to be transported in the packaging bag.

The activation of the sound chip can be done in any particular manner. For example mechanical means could be used causing a contact which activates the sound chip when the top is opened, or by electronic components, such as relays, which activate the sound chip.

According to another embodiment of the present invention, the sound chip is coupled to a switching unit arranged at the top and configured in such a way that the sound chip is activated when the top of the bag is opened. The coupling of the sound chip with a switching unit arranged at the top ensures in a particularly reliable manner that the sound chip is only activated when the top is actually opened. Malfunctioning, such as with the use of a switch which activates the sound chip as a function of the position of a side wall with respect to the bottom of the packaging bag, can thus be eliminated.

According to a particularly advantageous embodiment of the present invention, the switching unit is integrated in the closure means, in particular in the press stud. The press stud is coupled to the switching unit in such a way that the switching unit is activated when the press stud is opened. The press stud is particularly reliable, thereby avoiding malfunctions to a particular degree. Due to its outer appearance, which preferably is a metal or plastic housing, the switching unit arranged therein is especially well protected against environmental influences so that the functioning safety can be enhanced in a complementary manner.

Additionally increased stability of the packaging bag bottom, in particular the possibility of placing it in an upright position, results from another embodiment of the present invention, according to which the packaging bag bottom is formed by a block bottom. This embodiment of the invention facilitates the presentation of the packaging bag in a particular manner.

For a full understanding of the present invention, reference should now be made to the following detailed description of the preferred embodiment of the invention as illustrated in the accompanying drawing.

BRIEF DESCRIPTION OF THE DRAWING

FIG. 1 shows a packaging bag 1 of lacquered paper having a labeling 4 on a side wall 5. The colors of the paper and of the labeling are freely selectable. Two handles 3, which can also be of a particular color and can be of various materials or braids, are arranged at the top 2 of the packaging bag 1.

Figure 1:
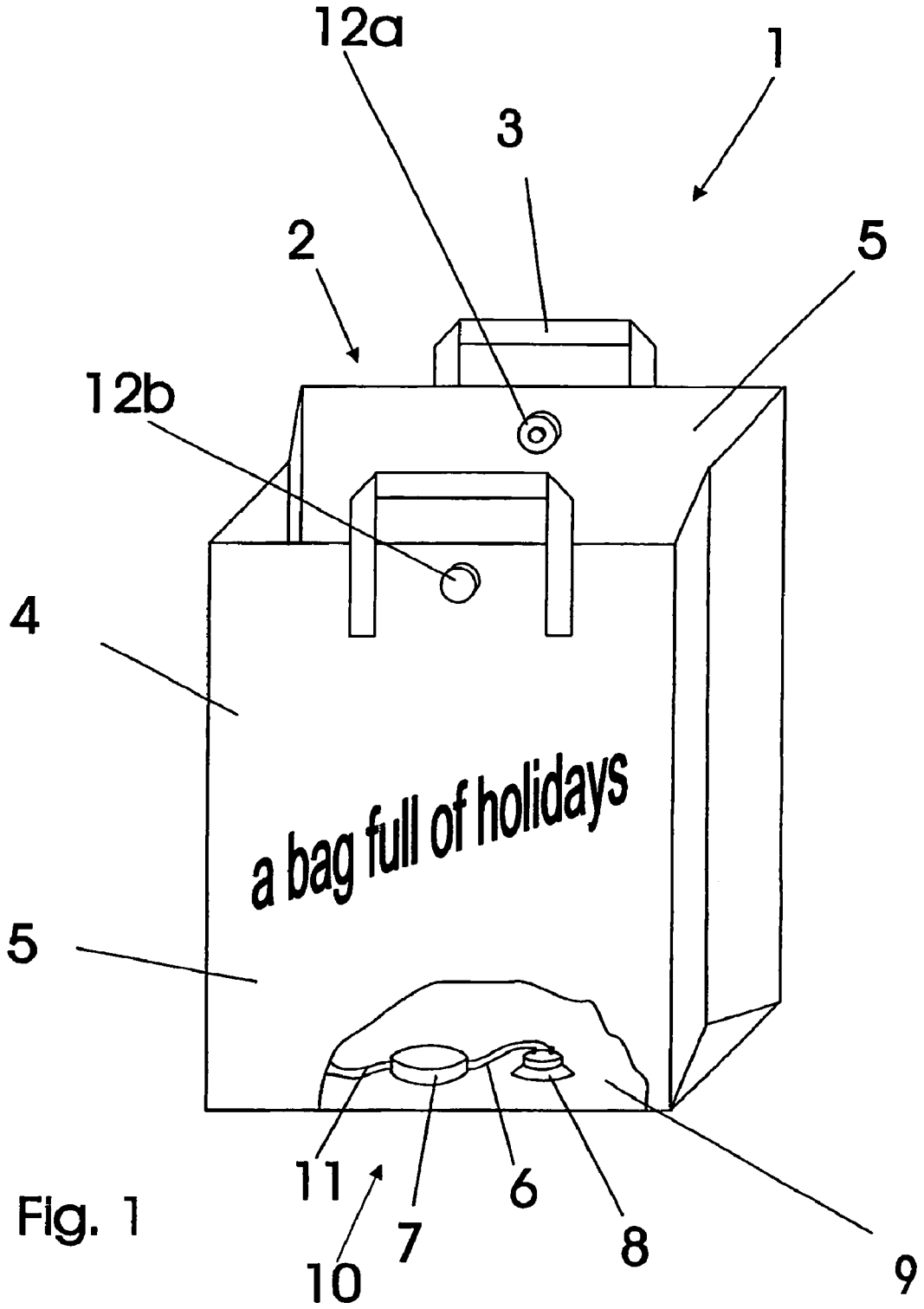
FIG. 1 is a perspective, partially cutaway view of a packaging bag.

A sound source 10 is arranged on the packaging bag bottom 9, comprising a sound chip 7 and a loudspeaker 8 coupled to it, interconnected via two linking lines 6.

DESCRIPTION OF THE PREFERRED EMBODIMENTS

The preferred embodiments of the present invention will now be described with reference to drawing.

To protect against the items within the packaging bag 1, an insert bottom (not shown) is arranged above the sound source 10, i.e. on the side facing the top 2 of the sound source 10.

To activate the sound chip 7, it is coupled to a switching unit (not shown) via two lines 11 and arranged in a press-stud top part (female side) 12*b* of a press stud comprised of a press-stud bottom part (male side) 12*a* and a press-stud top part (12*b*). When the top 2 of the packaging bag 1 is opened, i.e. when the press stud is disengaged, the sound chip 7 produces a sound background adapted to a label 4 reading, being arranged on the side wall 5, "a bag full of holidays", such as the sound of the sea or the cries of seagulls.

The press stud itself is a well-known ring spring press stud ensuring high functional reliability and having a press stud top part 12*b* thereof equipped with a switching unit.

The following is also conceivable: a combination of a label reading "a bag full of gold" with the sounds of an donkey, or a label reading "a bag full of parking" with the sound of a car repeatedly advancing and backing up with subsequent noise of a crash.

The contents contained in the packaging bag 1 can also be suitably adapted to the sounds and the labeling 4. In the case of the label 4 reading "a bag full of holidays" the contents could be, for example, small sea shells or a small packet of sand, or in the case of the labeling reading "a bag full of gold", a gold dollar could be arranged in the packaging bag 1. A multitude of labeling and sound combinations are also possible, for example alluding to certain hobbies, skills, images or customers of a firm.

There has thus been shown and described a novel gag bag which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A packaging bag, in particular of paper, plastic or a composite of these materials, having a closable top and a sound source which produces a single or a sequence of tones, intelligible sounds or noises when the top is opened, wherein the top can be closed by means of a closure device arranged at the top of the bag, the improvement wherein the closure device comprises a press stud having a female part and a male part adapted to be engaged and disengaged by a user; wherein the sound source comprises a sound chip and a loudspeaker associated therewith; wherein the sound chip is coupled to a switching unit disposed in the female part of the press stud; and wherein the switching unit is configured in such a way that the sound source is activated when the press stud is disengaged and the top of the bag is opened.

2. A packaging bag according to claim 1, wherein the sound source is coupled to a recording unit.

3. A packaging bag according to claim 1, wherein the loudspeaker is arranged in such a way that the sound waves produced are radiated toward the outside.

4. A packaging bag according to claim 1, wherein the loudspeaker and the sound chip are arranged in the packaging bag bottom.

5. A packaging bag according to claim 1, further comprising two carrying handles arranged at the top of the bag.

6. A packaging bag according to claim 1, wherein a bottom of the packaging bag is configured as a block bottom.

* * * * *